US008926213B1

(12) United States Patent
Shavitz

(10) Patent No.: US 8,926,213 B1
(45) Date of Patent: Jan. 6, 2015

(54) CONTACT ORGANIZING SYSTEM AND METHOD

(71) Applicant: Gregory Joel Shavitz, Irvine, CA (US)

(72) Inventor: Gregory Joel Shavitz, Irvine, CA (US)

( * ) Notice: Subject to any disclaimer, the term of this patent is extended or adjusted under 35 U.S.C. 154(b) by 6 days.

(21) Appl. No.: 13/742,896

(22) Filed: Jan. 16, 2013

(51) Int. Cl.
*B42F 13/40* (2006.01)

(52) U.S. Cl.
CPC ..... *B42F 13/404* (2013.01)
USPC ..... 402/1; 30/358; 40/124

(58) Field of Classification Search
CPC ..... B42F 13/404
USPC ..... 402/1, 20; 83/467.1; 40/124; 30/358
See application file for complete search history.

(56) References Cited

U.S. PATENT DOCUMENTS 3,975,105 A * 8/1976 Cline ..... 402/1
5,222,767 A * 6/1993 Volkema ..... 402/79
6,764,100 B1 7/2004 Miro
2006/0061082 A1 3/2006 Badillo
2013/0019450 A1* 1/2013 Rassouli ..... 24/595.1

FOREIGN PATENT DOCUMENTS

CH 610806 * 5/1979
DE 20002491 * 5/2000

OTHER PUBLICATIONS

Derwent Abstract of DE 200002491 (Published May 2000).*

* cited by examiner

*Primary Examiner* — Kyle Grabowski
(74) *Attorney, Agent, or Firm* — Eric Karich

(57) ABSTRACT

A contact organizing system has a ring device and a hole punching device. The ring device is shaped for holding the business cards. The hole punching device for adapted punching holes in the business cards. The hole punching device includes a hanging aperture through the hole punching device for hanging the hole punching device on the ring device.

8 Claims, 1 Drawing Sheet

CONTACT ORGANIZING SYSTEM AND METHOD

BACKGROUND OF THE INVENTION

1. Field of the Invention

This invention relates generally to contact organizing systems, and more particularly to a contact organizing system that organizes business cards on a ring for easy access.

2. Description of Related Art

Various prior art systems exist for organizing various papers on rings and the like for easy review and access.

Miro, U.S. Pat. No. 6,764,100, for example, teaches a stationary organizer in which pre-punched stationary is organized on a C-shaped ring. The C-shaped ring includes adjacent ends joined by a connecting member that includes a curvilinear spring.

Clemente Badillo, U.S. Application 2006/0061082, teaches a pocket address book that includes a plurality of loose leaves/business cards that are hold-punched for mounting on a loose ring device between end covers. When one of the loose leaves becomes obsolete due to changes in contact information, the loose leaf may be removed and new information printed on a new blank loose leaf.

The prior art teaches various devices for organizing sheets of information on a ring-type device. However, the prior art does not teach a system that includes, also mounted on the ring, a hole punching device so that the user may punch a hole in a business card upon receipt, and immediately file the card on the ring. The present invention fulfills these needs and provides further advantages as described in the following summary.

SUMMARY OF THE INVENTION

The present invention teaches certain benefits in construction and use which give rise to the objectives described below.

The present invention provides a contact organizing system for organizing business cards. The contact organizing system includes a ring device for holding the business cards; a hole punching device for punching holes in the business cards; and a hanging aperture through the hole punching device for hanging the hole punching device on the ring device.

A primary objective of the present invention is to provide a contact organizing system having advantages not taught by the prior art.

Another objective is to provide a contact organizing system that includes a hole punching device that enables the user to punch a hole in a business card upon receipt, and immediately file the card on a ring device.

Another objective is to provide a contact organizing system that is simple to use and inexpensive to manufacture.

A further objective is to provide a contact organizing system that can easily hold a large number of business cards, and that is easy to organize.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a contact organizing system 10 for organizing business cards 12.

Figure 1:
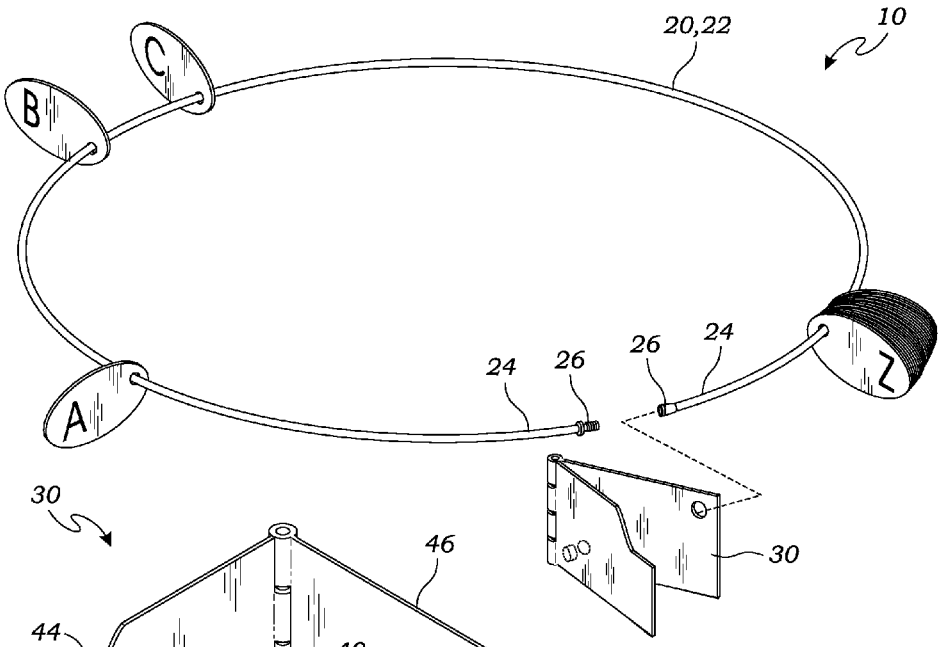
FIG. 1 is an exploded perspective view of a contact organizing system according to one embodiment of the present invention, the contact organizing system including a cord and a hole punching device.

FIG. 1 is an exploded perspective view of the contact organizing system 10 according to one embodiment of the present invention. As illustrated in FIG. 1, the contact organizing system 10 includes a ring device 20 for holding the business cards 12 (illustrated in FIG. 3), and a hole punching device 30 for punching holes in the business cards 12. The hole punching device 30 includes a hanging aperture 42 so that the hole punching device 30 may be mounted on the ring device 20 along with the business cards 12.

The ring device 20 may include any form of ring or similar device for holding the business cards 12. In the embodiment of FIG. 1, the ring device 20 is a cord 20 having a main body 22 and opposed ends 24. The main body 22 has a length and a diameter. A fastening element 26 is attached to each of the ends 24. The fastening elements 26 may be connected together such that the cord 20 forms a loop. In an alternative embodiment, the ring device 20 may be a solid spiral ring such as is used for holding car keys, a ring that may be otherwise opened, such as is shown in Clemente Badillo, U.S. Application 2006/0061082, or Miro, U.S. Pat. No. 6,764,100 (both of which are hereby incorporated by reference), or any other similar devices, binders, or holders known in the art.

Figure 2:
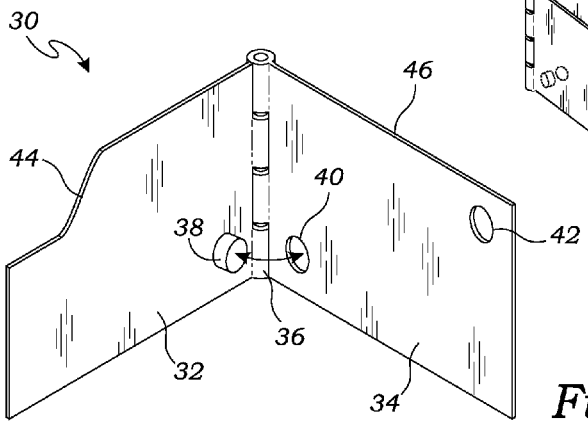
FIG. 2 is a perspective view of a hole punching device of FIG. 1.

FIG. 2 is a perspective view of the hole punching device 30 of FIG. 1. As illustrated in FIG. 2, in this embodiment the hole punching device 30 includes a first plate 32 and a second plate 34 held together by a hinge 36. The first plate 32 has a punching post 38 slightly larger than a thickness of the ring device 20. The second plate 34 has a punching aperture 40 sized and shaped to receive the punching post 38 such that the punching post 38 and punching aperture 40 together can cut one of the business cards 12 when the first and second plates 34 are compressed together.

The hinge 36 connects the first and second plate 32 and 34 and enables the first and second plate 32 and 34 to pivot with respect to each other between an open position in which the first and second plate 32 and 34 are apart from each other for receiving one of the business cards 12, to a closed position in which the first and second plate 32 and 34 close against each other and the punching post 38 nests within the punching aperture 40 and cut a hole in one of the business cards 12.

As discussed above, the hole punching device 30 includes the hanging aperture 42 for receiving the ring device 20 therethrough for hanging the hole punching device 30 on the ring device 20. In this manner, the hole punching device 30 is hung from the ring device 20 and used to cut holes in the business cards 12 so that the business cards 12 may also be hung from the ring device 20.

The first and second plate 32 and 34 are each generally rectangular in shape and are roughly the size of a standard business card. In this embodiment, the first plate 32 includes a recessed portion 44 that extends inwardly from a perimeter 46 of the hole punching device 30, further than the hanging aperture 42 of the second plate 34, so that when the hole punching device 30 is hung from the cord 20, the hole punching device 30 can still be closed without being blocked by the cord 20. The terms "first plate 32" and "second plate 34" are hereby expressly defined to include inverse embodiments in which the handling aperture and the recessed portion 44 are on opposite plates relative to the punching post 38 and the punching aperture 40.

While one embodiment of the hole punching device 30 is illustrated, alternative hole punching devices 30 may also be used, as long as they are capable of punching the necessary hole through a business card, and they are sized and shaped to fit on the cord 20.

Figure 3:
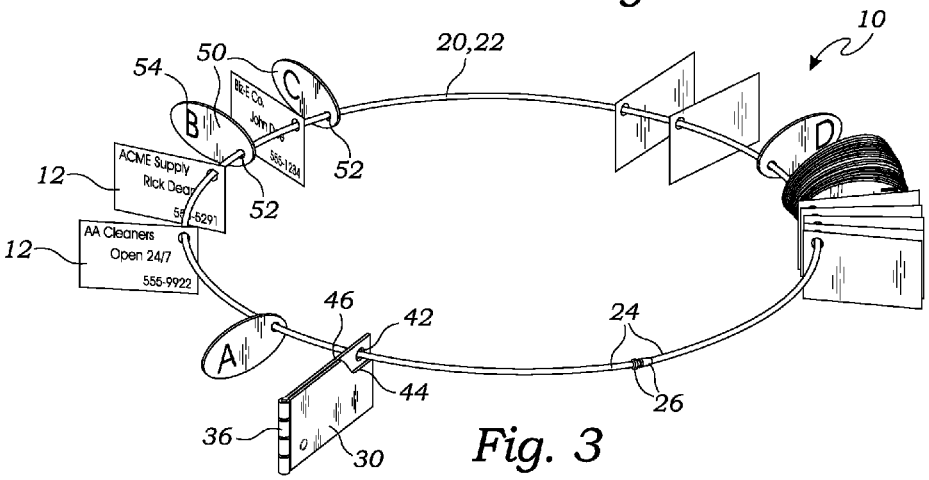
FIG. 3 is a perspective view of the contact organizing system of FIG. 1 once business cards have been organized on the cord of the contact organizing system.

FIG. 3 is a perspective view of the contact organizing system 10 of FIG. 1 once the business cards 12 have been organized on the cord 20 of the contact organizing system 10. As illustrated in FIG. 3, the contact organizing system 10 utilizes the ring device 20 for holding the business cards 12. The hole punching device 30 is attached to the ring device 20 using the hanging aperture 42, and may be used for punching holes in the business cards 12.

As illustrated in FIG. 2, the first and second plate 32 and 34 may be spread to the open position. In the open position, the business card may be inserted into the hole punching device 30 and the hole punching device 30 may then be moved to the closed position, illustrated in FIG. 3. If the business card is in the hole punching device 30 when it is moved to the closed position, the punching post 38 nests within the punching aperture 40 and cuts a hole in the business card so that it may be hung from the cord 20.

In the embodiment of FIG. 3, the contact organizing system 10 further comprises separator tabs 50 adapted to be mounted on the cord 20 for organizing the business cards 12. In this embodiment, the separator tabs 50 each include a tab aperture 52 for receiving the cord 20 therethrough, and further include alphabetical indicia 54 for facilitating organization of the business bards. The separator tabs 50 are positioned in alphabetical order for separating the business cards 12 into alphabetical order. Other organization systems may also be used, such as organizing the cards by category, date, or any other system desired by the user.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A contact organizing system for organizing business cards, the contact organizing system comprising:

a ring device for holding the business cards, wherein the ring device is a cord having a main body and opposed ends, and a fastening element at each of the ends, the fastening elements being connectable together such that the cord forms a loop;

a hole punching device for punching holes in the business cards;

a hanging aperture through the hole punching device, the ring device being positioned through the hanging aperture so that the hole punching device hangs on the ring device with the business cards; and wherein the hole punching device comprises:

a first plate having a punching post that is slightly larger than a diameter of the ring device;

a second plate having a punching aperture sized and shaped to receive the punching post such that the punching post and punching aperture together can cut one of the business cards when the first and second plates are compressed together;

a hinge connecting the first and second plates that enables the first and second plates to pivot with respect to each other between an open position in which the first and second plates are apart from each other for receiving the business cards, to a closed position in which the first and second plates close against each other and the punching post nests within the punching aperture and cut a hole in one of the business cards;

wherein the hanging aperture is through the first plate or the second plate for receiving the ring device therethrough for hanging the hole punching device on the ring device; and whereby the hole punching device hangs from the ring device so that it may be used to punch holes in the business cards so that the business cards may also be hung from the ring device.

2. The contact organizing system of claim 1, wherein the first and second plates are each generally rectangular in shape and are roughly the size of a standard business card.

3. The contact organizing system of claim 1, wherein either the first plate or the second plate includes a recessed portion that extends inwardly from a perimeter of the hole punching device further than the hanging aperture, so that when the hole punching device is hung from the ring device the hole punching device may be moved to the closed position without being blocked by the ring device.

4. The contact organizing system of claim 1, wherein the ring device is a cord having a main body and opposed ends, and a fastening element at each of the ends, the fastening elements being connectable together such that the cord forms a loop.

5. The contact organizing system of claim 1, further comprising separator tabs mounted on the cord for organizing the business cards on the ring device.

6. The contact organizing system of claim 1, further comprising alphabetical separator tabs adapted to be mounted on the cord in alphabetical order for separating the business cards into alphabetical order.

7. A contact organizing system for organizing business cards, the contact organizing system comprising:

a cord having a main body and opposed ends, the main body having a length and a diameter;

a fastening element at each of the ends, the fastening elements being connectable together such that the cord forms a loop;

a hole punching device for punching holes in the business cards, the hole punching device comprising:

a first plate having a punching post slightly larger than the diameter of the cord;

a second plate having a punching aperture sized and shaped to receive the punching post such that the punching post and the punching aperture together can cut one of the business cards when the first and second plates are compressed together, wherein the first and second plates are each generally rectangular in shape and are roughly the size of a standard business card;

a hinge connecting the first and second plates that enables the first and second plates to pivot with respect to each other between an open position in which the first and second plates are apart from each other for receiving one of the business cards, to a closed position in which the first and second plates close against each other and the punching post nests within the punching aperture and cut a hole in one of the business cards; and a hanging aperture through the first or second plate for receiving the cord therethrough for hanging the hole punching device on the cord; and whereby the hole punching device may be hung from the cord and used to cut holes in the business cards so that the business cards may be hung from the cord.

8. A method for organizing business cards, the method comprising the steps of:

providing a cord having a main body and opposed ends, the main body having a length, a diameter, and having a fastening element at each of the ends, the fastening elements being connectable together such that the cord forms a loop;

providing a hole punching device for punching holes in the business cards, the hole punching device comprising a first plate having a punching post slightly larger than the diameter of the cord, a second plate having a punching aperture sized and shaped to receive the punching post, and a hinge connecting the first and second plates;

hanging the hole punching device on the cord;

spreading the first and second plates so that the hole punching device is in an open position;

inserting one of the business cards into the hole punching device;

moving the hole punching device to a closed position in which the first and second plates close against each other and the punching post nests within the punching aperture and cut a hole in one of the business cards; and hanging the business card on the cord.

* * * * *